US006102055A

United States Patent [19]

Karnatz

[11] Patent Number: 6,102,055

[45] Date of Patent: Aug. 15, 2000

[54] CATION BEAD RAZOR BLADE CLEANING APPARATUS

[76] Inventor: Walter W. Karnatz, 1332 Citrus Isle, Ft. Lauderdale, Fla. 33315

[21] Appl. No.: 08/789,483

[22] Filed: Jan. 27, 1997

[51] Int. Cl.[7] ..... B08B 3/04

[52] U.S. Cl. ..... 134/88; 134/201; 134/135; 206/0.5

[58] Field of Search ..... 206/0.5; 134/2, 134/3, 7, 8, 135, 201, 88; 510/439, 441, 245, 252, 269, 161; 205/704, 705, 713, 712; 204/242

[56] References Cited

U.S. PATENT DOCUMENTS

| | | | |
|---|---|---|---|
| 886,075 | 4/1908 | Remington . | |
| 1,618,661 | 2/1927 | Humbert . | |
| 1,978,716 | 10/1934 | Morehouse | 91/62.5 |
| 1,983,011 | 12/1934 | Troll | 15/218 |
| 2,077,246 | 4/1937 | Mayr | 15/218 |
| 2,121,875 | 6/1938 | Kruse et al. . | |
| 2,289,508 | 7/1942 | Lawler . | |
| 2,465,440 | 3/1949 | Fleckenstine | 15/218 |
| 2,748,413 | 6/1956 | Morrow | 15/218 |
| 3,754,871 | 8/1973 | Hessel et al. . | |
| 3,982,357 | 9/1976 | Eldredge et al. | 51/181 R |
| 4,201,599 | 5/1980 | Morgans . | |
| 4,636,368 | 1/1987 | Pralus . | |
| 4,747,949 | 5/1988 | Barkey . | |
| 4,838,949 | 6/1989 | Dugrot | 134/32 |
| 4,874,486 | 10/1989 | Hanulik . | |
| 4,931,102 | 6/1990 | Burke . | |
| 5,091,080 | 2/1992 | Van Eikeren et al. . | |
| 5,147,575 | 9/1992 | Hampton, Sr. . | |
| 5,342,450 | 8/1994 | Crockell, Jr. et al. . | |
| 5,447,684 | 9/1995 | Williams . | |
| 5,471,705 | 12/1995 | Dao | 15/236.05 |

*Primary Examiner*—Frankie L. Stinson
*Attorney, Agent, or Firm*—Oltman, Flynn & Kubler

[57] ABSTRACT

An apparatus for removing deposits from a razor blade includes a quantity of cation source material, a vessel retaining a cation carrying medium, and a medium and cation permeable barrier dividing the vessel and the medium into a blade placement region and a material retaining region, for separating the quantity of cation source material from the razor blade. The cation source material preferably includes several plastic beads. The medium permeable barrier is preferably a wire mesh. The cation carrying medium preferably includes water. A method of removing deposits from a razor blade includes the steps of: providing an apparatus including a vessel containing a water medium and cation source material at least partly submerged in the water medium, and immersing the blade in the water medium for a length of time to permit cations supplied by the material to react with the deposits on the blade.

12 Claims, 1 Drawing Sheet

CATION BEAD RAZOR BLADE CLEANING APPARATUS

BACKGROUND OF THE INVENTION

1. Field of the Invention

The present invention relates generally to the field of cleaning devices for razor blades. More specifically the present invention relates to an apparatus for extending the life of blades by keeping them clean of mineral and related deposits which cause blades to become dull long before the edge is lost through wear.

The first embodiment includes a quantity of cation source beads retained within a water and cation permeable mesh sack. The mesh sack is tied to a first end of a length of string, much like a tea bag. At the second end of the string is attached a cardboard or paper panel for gripping by the user when lifting the sack. The sack is dropped into a cup or other vessel containing water. The blade end of a razor is immersed in the water beside the sack, and the cations supplied by the beads react with and deplete deposits on the blade.

The second embodiment includes a cup or other vessel having a bead retaining region and a blade receiving region separated by a water and cation permeable mesh partition. A quantity of the cation source beads is provided in the bead retaining region. Water is poured into the cup to a level above or beside the mesh, entering the bead area through the mesh. The blade end of a razor is placed into the cup, where it becomes immersed in the water and comes to rest on top of or beside the mesh partition, in close proximity to the beads.

A method of razor blade cleaning is provided according to the invention including the step of immersing the blade end of a razor in a cation carrying medium in close proximity to cation source material which produces cations in the medium. The blade is kept immersed with the material between razor uses, such as overnight.

2. Description of the Prior Art

There have long been devices for cleaning whiskers and other debris from the surfaces of razor blades. These devices have been largely ineffective because they do not remove the primary cause of blade dulling, which is deposit build-up at the edge.

Humbert, U.S. Pat. No. 1,618,661, issued on Feb. 22, 1927, discloses a sanitary device for cleaning and wiping razors. Humbert is apparently intended for the old-style straight razors. A length of fabric is unwound from a first spool and rolled over a roller at the top of the device and then wound onto a second spool. The blade of the razor is drawn across the fabric portion covering the roller at the moment, to transfer any shaving cream and hair onto the fabric. Then the spools are rotated to advance the fabric portion to slide against a sharp edge of a debris gathering box into which the deposited debris falls. A problem with Humbert is that it does not teach removal of deposits adhering to the blade surfaces.

Morehouse, U.S. Pat. No. 1,978,716, issued on Oct. 30, 1934, reveals a razor blade lubricator apparatus for wiping and oiling the more modern, replaceable, rectangular razor blades. Morehouse includes a case which has a reservoir adapted to be filled with lubricating fluid and which has a blade passing slot along its top and one or both ends for passing the blade into and out of the case. The case contains a pair of oppositely disposed absorbent pads arranged adjacent to the slot to engage opposite sides of the blade as it is drawn through the slot between the pads. The lubricating fluid used is one such as petroleum jelly or vaseline. Once again, cation removal of adhering deposits is not suggested.

Troll, U.S. Pat. No. 1,983,011, issued on Dec. 4, 1934, discloses a razor blade wiper and drier apparatus. Troll includes several circular disks of absorbent material to which may be added outside disks of celluloid. The disks are tightly fastened together face to face at their centers and are open at their periphery for insertion of the blade, thus providing a contact surface of absorbent material. The wiping disks may be saturated with oil or other cleaning, lubricating and rust preventing preparation. Cation cleaning of deposits is not contemplated in Troll.

Mayr, U.S. Pat. No. 2,077,246, issued on Apr. 13, 1937, discloses an apparatus for cleaning razor blades. Mayr teaches cleaning the blades by sliding them against porous materials. The blade is held by pins on the apparatus, which includes a bar-form slider assembly, and the blade is carried with its edges between runners on both sides of the slider assembly and covered with porous material. The runners are formed by suitable grooving or cutting away of a fixed lower part and an upper part of the slider assembly, closing onto the lower part. Lather is removed from the edges of the blades, and the blades are at the same time dried, during passage of the blade edges between the pads of the porous material, which are arranged above, below and on each side of the slider assembly. The porous material can be strips of paper or of cotton fabric. Once again, no cation removal of deposits is revealed.

Fleckenstine, U.S. Pat. No. 2,465,440, issued on Mar. 29, 1949, discloses a razor cleaning device. Fleckenstine includes a pair of wiping or drying pads. Each pad is composed of a layer of absorbent material, such as flannel, attached to a layer of stiffer backing material such as fiber board. The pads are secured face to face and arranged to permit a wet razor blade to be passed between them for drying contact with their absorbent surfaces. The pads are tightly joined together to exert pressure on the faces of the blade at the edges being cleaned. This sort of wiping action is generally insufficient to remove caked deposits.

Morrow, U.S. Pat. No. 2,748,413, issued on Jun. 5, 1956, discloses a razor drying holder apparatus. Morrow includes a container having a slotted opening. A desiccant receiving member is positioned within the container and a slot extends through the receiving member which is positioned to register with the container slotted opening. The desiccant receiving member includes a porous slot lining, and a holding pin extends through the slots in the container and desiccant receiving member to receive, pass and position a razor blade within the container. The desiccant may include a hygroscopic substance such as calcium chloride which may be mixed with a body material, such as infusorial earth. A cation cleaning is not provided.

Eldridge, et al., U.S. Pat. No. 3,982,357, issued on Sep. 28, 1976, teaches a cleaning device for cauterizing knives and forceps intended for use during a single surgical operation, and then to be discarded. The device includes a pair of confronting abrasive strips urged into mutual engagement by opposed resilient porous pads which wipe loosened particles from the cauterizing knife or forceps. A frame structure receives the abrasive strips and pads, and is further provided with side extensions for clamping engagement by an atraumatic clip for attachment of the device to a surgical towel or drape. The frame also provides additional structures for receiving cauterizing knifes or an electrical cord forming part of the cauterizing equipment. Once again cleaning is accomplished with abrasion which may not remove mineral deposits.

Dao, U.S. Pat. No. 5,471,705, issued on Dec. 5, 1995, discloses a cauterizer blade wiping device. Dao includes a body having a wall with one or more elongated slots. The body has sidewalls extending between the inner and outer surfaces of the wall. A cauterizer blade is drawn through a slot in any suitable orientation to wipe debris from the blade. A sidewall of each slot is bounded by a longitudinal inner edge along the inner surface of the wall and a longitudinal outer edge along the outer surface of the wall. Each of the two surfaces of the cauterizer blade contacts one inner edge when the blade is drawn through the slot, to wipe or scrape the blade. The sidewalls have a beveled appearance and provide chisel-like inner edges to enhance the wiping action. While this scraping action may remove loose debris, as stated, it would be largely ineffective in removing adhering mineral deposits.

Dugrot, U.S. Pat. No. 4,838,949, issued on Jun. 13, 1989, provides a shaving razor cleaner device. Dugrot includes an upper chamber which fits with water-tight engagement onto a conventional tap water faucet and includes a lower chamber for blade cleaning. The lower chamber is connected to receive fluid from the upper chamber by a constricting passageway which passes and accelerates the stream of water from the faucet. The accelerated stream of water sprays into the lower chamber against a deflector plate, which fans out the water stream and distributes it uniformly and energetically against the blade area of the razor. The razor head may slide underneath the fanned stream on guide rails. A problem with Dugrot is that water impact of this magnitude is insufficient to remove blade dulling deposits.

It is thus an object of the present invention to provide a razor blade cleaning apparatus which prevents build-up of and removes mineral and other deposits from the cutting edges of razor blades to prevent dulling of the blades and thus to substantially increase blade life.

It is another object of the present invention to provide such an apparatus which removes mineral and other deposit build-up by placing the blade in a cation carrying medium in the general vicinity of cation source material.

It is still another object of the present invention to provide such an apparatus which includes cation material in the form of beads, and which separates these beads from the blade with a partition permeable to the medium and to cations.

It is finally an object of the present invention to provide such an apparatus which is inexpensive to manufacture, convenient to use, reliable and which remains effective throughout numerous blade cleanings.

SUMMARY OF THE INVENTION

The present invention accomplishes the above-stated objectives, as well as others, as may be determined by a fair reading and interpretation of the entire specification.

An apparatus is provided for removing deposits from a razor blade, including a quantity of cation source material, a vessel retaining a cation carrying medium, and a medium and cation permeable barrier dividing the vessel and the medium into a blade placement region and a material retaining region, for separating the quantity of cation source material from the razor blade.

The cation source material preferably includes several plastic beads. The medium permeable barrier is preferably a wire mesh. The cation carrying medium preferably includes water.

An apparatus is also provided for removing deposits from a razor blade, including a quantity of cation source material, a vessel retaining a quantity of water, and a water and cation permeable, and cation source material impermeable, barrier dividing the vessel and the quantity of water into a blade placement region and a material retaining region, for separating the quantity of cation source material from the razor blade.

The barrier is preferably configured to form a closed sack retaining the material. The apparatus preferably additionally includes an elongate flexible member having a first member end and a second member end and additionally includes a finger grip panel member, where the sack is connected to the first member end and the panel member is connected to the second member end. The vessel alternatively includes a material retaining region and a blade receiving region, where the barrier is a partition dividing the vessel into the material retaining region and the blade receiving region. Once again, the cation source material preferably includes several plastic beads.

An apparatus is further provided including a blade having deposits on it, a quantity of cation source material, and a vessel containing a cation carrying medium, in which the cation source material and the blade are immersed. Once again, the cation source material preferably includes several plastic beads.

A method is provided of removing deposits from a razor blade, including the steps of: providing an apparatus including a vessel containing a water medium and cation source material at least partly submerged in the water medium, and immersing the blade in the water medium for a length of time to permit cations supplied by the material to react with the deposits on the blade.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
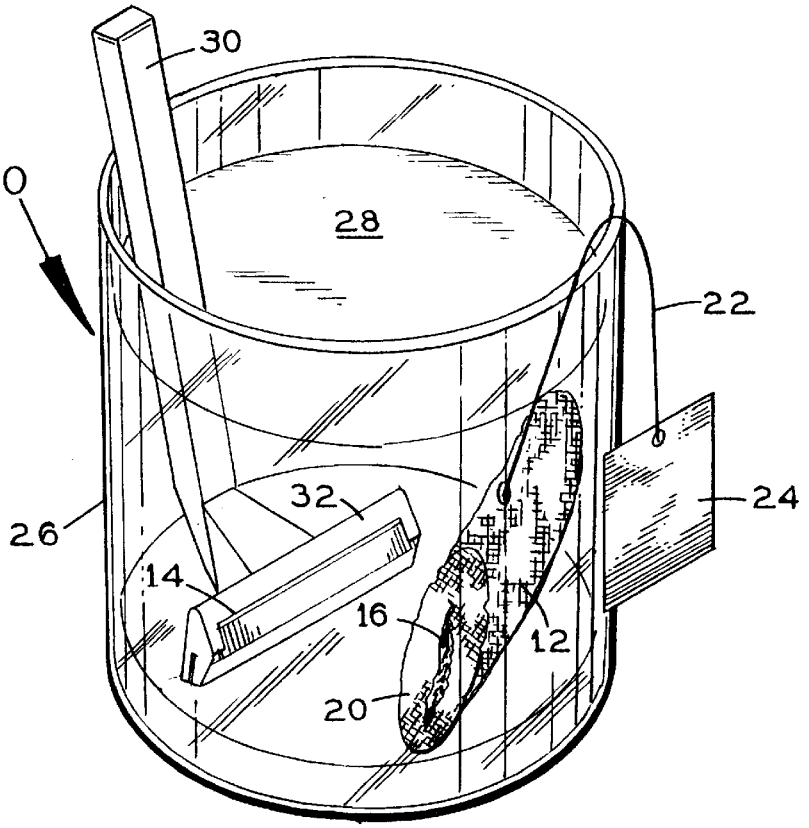
FIG. 1 is a cross-sectional side view of a conventional cup containing water and containing the first embodiment of the apparatus having the sack configuration.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
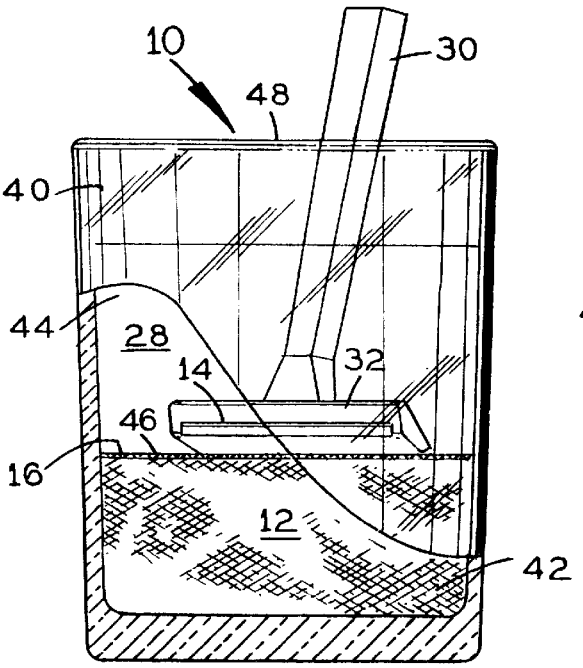
FIG. 2 is a cross-sectional side view of the second embodiment of the apparatus having the specialized vessel configuration, with the partition dividing the vessel into upper and lower regions.
Figure 3:
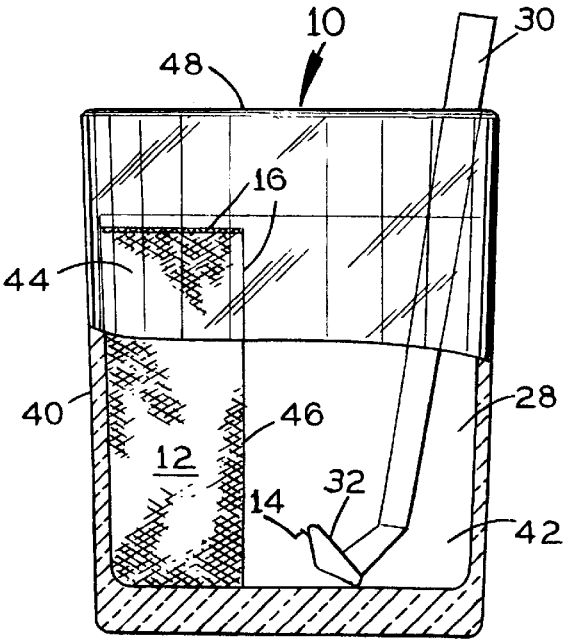
FIG. 3 is variation of the second embodiment of the apparatus in which the partition extends both vertically and horizontally to divide the cup into side regions or compartments.

Referring to FIGS. 1–3, a razor blade cleaning apparatus 10 is disclosed for removing deposits, such as of minerals, adhering to surfaces of the razor blade 14. Apparatus 10 generally includes cation source material which releases, creates by charging other molecules already present or otherwise supplies cations when placed in a suitable medium. The source material preferably takes the form of plastic beads 12, which are separated from the blade 14 to be cleaned by a fine metal or plastic wire mesh 16 barrier. Cations supplied by the beads 12 are dispersed in the water to react and combine with the particles of mineral elements making up the deposits on the blade 14.

The first embodiment includes a quantity of the cation source beads 12 retained within a sack 20 made of the mesh 16, which is water and cation permeable. See FIG. 1. Sack 20 is tied to a first end of a length of string 22, much like a tea bag. At the second end of string 22 is attached a cardboard or paper panel 24 for gripping by the user when lifting the sack 20. Sack 20 is lowered into a conventional cup 26 or other suitable vessel containing water 28 or other suitable and equivalent cation carrying medium, and sack 20 sinks to the bottom of cup 26, because the beads 12 are heavier per unit of volume than the water 28. The blade 14 of a razor 30 is immersed in the water 28 as well, and thus is necessarily in close proximity to sack 20.

Beads 12 are a standard product used in many water softeners for removing minerals from water, and are therefore known to be safe for home use. Beads 12 are preferred over large blocks of cation source material because they present greater surface area for cation release. The use of many other types and configurations of cation source material are, however, contemplated. The mesh 16 barrier is fine enough to retain beads 12 against lodging in the slots and openings around the razor blade 30 and blade mounting head 32, and against scattering in the event of water spillage.

Second Preferred Embodiment

The second embodiment includes a cup 40 having a cup lower region 42 and a cup upper region 44 separated by a water and cation permeable mesh partition 46. See FIG. 2. A quantity of the cation source beads 12 is retained in cup lower region 42. Water 28 or other suitable medium is poured into cup 40 to a level above partition 46, entering and filling lower region 42 to a level sufficiently above partition 46 for immersion of beads 12 and of blade 14. Blade 14 of razor 30 is placed into cup 40 through the cup 40 open top 48, where it becomes immersed in the water 28 and comes to rest on top of the wire mesh partition 46, where it is in close proximity to beads 12. Many vessel configurations other than that of cup 40 are contemplated, and partition 46 may divide the vessel into regions other than upper and lower. See FIG. 3. Suitable permeable barriers other than mesh are also contemplated.

As a variation of the second embodiment, partition 46 may be omitted. In this event, it is preferred that the material 12 be anchored to the interior of cup 40.

Method

In practicing the invention, the following method may be used. A method of razor blade 14 cleaning is provided according to the invention including the step of immersing the blade 14 of the razor 30 in water 28 or other suitable medium in close proximity to a quantity of cation source material 12 which supplies cations to the water 28. The blade 14 is kept immersed with the material 12 between razor 30 uses, such as overnight, for a sufficient cation exposure time to remove deposits from blade 14.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

PARTS LIST

10. Apparatus
12. Plastic cation source beads
14. Razor blade portion
16. Mesh
20. Sack of first embodiment
22. String on sack
24. Paper panel on string
26. Conventional cup of first embodiment
28. Water
30. Razor as a whole
32. Blade mounting head of razor
40. Specialized cup of the second embodiment
42. Cup lower region
44. Cup upper region
46. Partition in cup
48. Cup open top

I claim as my invention:

1. An apparatus for removing deposits from a razor blade, comprising:

a quantity of cation source material, a vessel retaining a cation carrying medium, and a medium and cation permeable barrier dividing said vessel and said medium into a blade placement region and a material retaining region, for separating said quantity of cation source material from the razor blade.

2. An apparatus according to claim 1, wherein said cation source material comprises a plurality of plastic beads.

3. An apparatus according to claim 1, wherein said medium permeable barrier comprises a wire mesh.

4. An apparatus according to claim 1, wherein said cation carrying medium comprises water.

5. An apparatus for removing deposits from a razor blade, comprising:

a quantity of cation source material, a vessel retaining a quantity of water, and a water and cation permeable, and cation source material impermeable, barrier dividing said vessel and said quantity of water into a blade placement region and a material retaining region, for separating said quantity of cation source material from the razor blade.

6. An apparatus according to claim 5, wherein said barrier is configured to form a closed sack retaining said material.

7. An apparatus according to claim 6, additionally comprising an elongate flexible member having a first member end and a second member end and additionally comprising a finger grip panel member, wherein said sack is connected to said first member end and said panel member is connected to said second member end.

8. An apparatus according to claim 5, wherein said vessel comprises a material retaining region and a blade receiving region, and wherein said barrier is a partition dividing said vessel into said material retaining region and said blade receiving region.

9. An apparatus according to claim 5, wherein said cation source material comprises a plurality of plastic beads.

10. An apparatus for removing deposits from a razor blade, comprising:

a quantity of cation source material, a vessel retaining a cation carrying medium, and a medium and cation permeable barrier dividing said vessel and said medium into a blade placement region and a material retaining region, for separating said quantity of cation source material from the razor blade;

wherein said cation source material comprises a plurality of plastic beads.

11. An apparatus for removing deposits from a razor blade, comprising:

a quantity of cation source material, a vessel retaining a quantity of water, and a water and cation permeable, and cation source material impermeable, barrier dividing said vessel and said quantity of water into a blade placement region and a material retaining region, for separating said quantity of cation source material from the razor blade;

wherein said vessel comprises a material retaining region and a blade receiving region, and wherein said barrier is a partition dividing said vessel into said material retaining region and said blade receiving region.

12. An apparatus for removing deposits from a razor blade, comprising:

a quantity of cation source material, a vessel retaining a quantity of water, and a water and cation permeable, and cation source material impermeable, barrier dividing said vessel and said quantity of water into a blade placement region and a material retaining region, for separating said quantity of cation source material from the razor blade;

wherein said cation source material comprises a plurality of plastic beads.

* * * * *